US010989007B2

(12) United States Patent
McCarthy et al.

(10) Patent No.: US 10,989,007 B2
(45) Date of Patent: Apr. 27, 2021

(54) DOWNHOLE CASING PATCH

(71) Applicant: Torsch Inc., Calgary (CA)

(72) Inventors: Matthew McCarthy, Calgary (CA); Grant George, Calgary (CA)

( * ) Notice: Subject to any disclaimer, the term of this patent is extended or adjusted under 35 U.S.C. 154(b) by 94 days.

(21) Appl. No.: 16/091,963

(22) PCT Filed: Apr. 10, 2017

(86) PCT No.: PCT/CA2017/050440
§ 371 (c)(1),
(2) Date: Oct. 5, 2018

(87) PCT Pub. No.: WO2017/173554
PCT Pub. Date: Oct. 12, 2017

(65) Prior Publication Data

US 2019/0120006 A1 Apr. 25, 2019

Related U.S. Application Data

(60) Provisional application No. 62/320,209, filed on Apr. 8, 2016.

(51) Int. Cl.
*E21B 29/10* (2006.01)
*E21B 33/124* (2006.01)
*E21B 33/128* (2006.01)

(52) U.S. Cl.
CPC ..... *E21B 29/10* (2013.01); *E21B 33/124* (2013.01); *E21B 33/128* (2013.01)

(58) Field of Classification Search
CPC ..... E21B 29/10; E21B 33/124; E21B 33/128; E21B 23/00
See application file for complete search history.

(56) References Cited

U.S. PATENT DOCUMENTS

| | | | | |
|---|---|---|---|---|
| 6,276,690 | B1 | 8/2001 | Gazewood | |
| 8,146,685 | B2 | 4/2012 | Lee et al. | |
| 2008/0164017 | A1 | 7/2008 | George et al. | |
| 2016/0138361 | A1* | 5/2016 | Clemens | E21B 43/105 166/387 |

FOREIGN PATENT DOCUMENTS

| | | |
|---|---|---|
| CA | 2885094 | 9/2015 |

OTHER PUBLICATIONS

International Searching Authority, The International Search Report and the Written Opinion of the International Searching Authority, or the Declaration, International Application No. PCT/CA2017/050440, Filed Apr. 10, 2017, 13 pages, Receiving Office—Canadian Intellectual Property Office.

* cited by examiner

*Primary Examiner* — Brad Harcourt
(74) *Attorney, Agent, or Firm* — Richard D. Okimaw

(57) ABSTRACT

An apparatus for bridging a section of ruptured casing within an oil well comprising a length of bridging pipe extending between first and second ends sized to be located within the casing so as to span the section of ruptured casing, a first seal located around the bridging pipe proximate to the first end thereof, a second seal located around the bridging pipe proximate to the second end thereof, an installation assembly extending through the bridging pipe operably engaged with the first and second ends of the bridging pipe, wherein the installation assembly is operable to extend each of the first and second seals into engagement with the oil well and wherein the installation assembly is further operable to selectably disengage from the bridging pipe.

15 Claims, 25 Drawing Sheets

DOWNHOLE CASING PATCH

BACKGROUND OF THE INVENTION

1. Field of Invention

The present invention relates generally to a method and apparatus for bridging and sealing a compromised downhole casing.

2. Description of Related Art

In hydrocarbon production, many casings or production tubes may be prone to fatigue and/or wear. These stresses on the casing may cause such casing to crack or rupture leading to loss of integrity of the well bore. Such operations may occur in the case of steam assisted gravity drainage or SAGD operations or primary operations.

One method of repairing such a rupture is to provide a bridging pipe or liner inside of the ruptured casing with seals on each end. However present methods of installing and activating such bridges are time consuming and difficult to install. Such conventional bridging pipes have also suffered from short service lives and have been unable to be retrieved from the well.

SUMMARY OF THE INVENTION

According to a first embodiment of the present invention, there is disclosed an apparatus for bridging a section of ruptured casing within an oil well comprising a length of bridging pipe extending between first and second ends sized to be located within the casing so as to span the section of ruptured casing, a first seal located around the bridging pipe proximate to the first end thereof, a second seal located around the bridging pipe proximate to the second end thereof, an installation assembly extending through the bridging pipe operably engaged with the first and second ends of the bridging pipe, wherein the installation assembly is operable to extend each of the first and second seals into engagement with the oil well and wherein the installation assembly is further operable to selectably disengage from the bridging pipe.

The first seal may comprise top and bottom first seal collet arms extending away from a first seal retaining ring disposed around the bridging pipe, each of the top and bottom first seal collet arms extending to distal ends having outwardly oriented pipe engagement surfaces, top and bottom first seal cones positioned adjacent to the distal ends of the top and bottom first seal collet arms around the bridging pipe, first seal engagement sleeve surrounding the bridging pipe proximate to the first end thereof and a first seal element extending around the bridging pipe between the top first seal cone and the first seal engagement sleeve The first seal retaining ring, the top first seal cones and the first seal engagement sleeve may be temporarily secured to the bridging pipe with shear pins. The shear pins securing the first seal retaining ring, the top first seal cones and the first seal engagement sleeve may be sheared in order from top to bottom as the bridging pipe moves therethrough. The first seal retaining ring, the top first seal cones and the first seal engagement sleeve may be removed from engagement with the oil well by retrieval rings adapted to engage thereupon. The first seal retaining ring, the top first seal cones and the first seal engagement sleeve may be engaged upon in order from top to bottom by the retrieval rings.

The second seal may comprise top second seal collet arms extending downwardly from a top collet retaining ring disposed around the bridging pipe, the top second seal collet arms extending to distal ends having outwardly oriented pipe engagement surfaces, top and bottom second seal cones positioned below the top second seal collet arms around the bridging pipe, a second seal element extending around the bridging pipe between the top and bottom second seal cones, bottom second seal collet arms extending upwardly from a bottom collet retaining ring disposed around the bridging pipe, the bottom second seal collet arms extending to distal ends having outwardly oriented pipe engagement surfaces, second seal engagement sleeve surrounding the bridging pipe proximate to the second end thereof and The top collet retaining ring, the top and bottom second seal cones, the bottom retaining ring and the second seal engagement sleeve are temporarily secured to the bridging pipe with shear pins.

The shear pins securing the top collet retaining ring, the top and bottom second seal cones, the bottom retaining ring and the second seal engagement sleeve may be sheared in order from bottom to top as the bridging pipe moves therethrough. The top collet retaining ring, the top and bottom second seal cones, the bottom retaining ring and the second seal engagement sleeve may be removed from engagement with the oil well by retrieval rings adapted to engage thereupon. The top collet retaining ring, the top and bottom second seal cones, the bottom retaining ring and the second seal engagement sleeve may be engaged upon in order from top to bottom by the retrieval rings. The shear pin securing the top collet retaining ring is sized larger than the shear pins securing the top and bottom second seal cones, the bottom retaining ring and the second seal engagement sleeve may be temporarily secured to the bridging pipe with shear pins. The apparatus may further comprise a selectably compressible sleeve between the top second seal cone and the second seal element.

The selectably compressible sleeve may comprises a plurality of release arms extending from a sleeve adjacent to the second seal element, the plurality of release arms having end surfaces selectably engageable with a corresponding receptacle sleeve extending from the top second seal cone, wherein the end surfaces of the release arms are maintained in engagement with the receptacle sleeve by the bridging pipe, wherein the recess is located at a position along the bridging pipe corresponding to a position at which the release arms are desired to be released from engagement with the receptacle sleeve.

The bridging pipe may include a plurality of longitudinal slots extending therealong and further including a carriage within each slot in engagement with the second seal engagement sleeve so as to transmit longitudinal movement of a tool inside the bridging pipe to the second seal engagement sleeve.

According to a further embodiment of the present invention, there is disclosed a method for bridging a section of pipe having a compromised section comprising providing a length of bridging pipe extending between first and second ends located within the casing so as to span the section of ruptured casing, locating an installation assembly within the bridging pipe, positioning the bridging pipe within the pipe so as to span the section of ruptured casing, with the installation assembly, longitudinally compressing the first end of the bridging pipe so as to extend a first seal therearound located proximate to the first end of the bridging pipe, releasing the installation assembly from the first end of the bridging pipe, with the installation assembly, longitudinally compressing the second end of the bridging pipe so as to extend a second seal therearound located proximate to the second end of the bridging pipe, releasing the installation assembly from the second end of the bridging pipe, removing the installation assembly from the bridging pipe.

According to a further embodiment of the present invention, there is disclosed an apparatus for selectively decoupling a setting tool from a pipe comprising an inner tubular body locatable within the pipe, an outer tubular body located annularly between the pipe and the inner tubular body, a plurality of collet arms extending from the outer tubular body, the plurality of collet arms having an exterior gripping surface engagable upon the pipe and a catch extending between the inner tubular body and the outer tubular body so as to selectably lock the inner and outer tubular bodies together.

The catch may comprise at least one radially movable pin extending between aid inner and outer tubular bodies wherein the at least one pin engages the inner and outer tubular body at a first radially extended position and disengages from the outer tubular body at a second radially compressed position. The apparatus may further comprise a sleeve longitudinally displaceable within a central bore of the inner tubular body so as to retain the at least one pin at the first position. The sleeve is longitudinally displaceable to permit the at least one pin to move to the second position.

The inner tubular body includes a cone at a position to bias the plurality of collet arms into engagement with the pipe at an initial position.

According to a further embodiment of the present invention, there is disclosed a method for selectively decoupling a setting tool from a pipe comprising locating an inner tubular body within the pipe, locating an outer tubular body annularly between the pipe and the inner tubular body, biasing a plurality of collet arms extending from the outer tubular body into engagement with the pipe and selectably longitudinally retaining inner and outer tubular bodies relative to each other with a catch extending between the inner tubular body and the outer tubular body so as to selectably.

According to a further embodiment of the present invention, there is disclosed a n apparatus for selectively retaining and releasing a dropped ball within a down hole tool comprising a body locatable within the down hole tool having a central passage therethrough, the central passage having an enlarged cavity section, a slidably tubular member having a central passage therethrough located within the cavity section, a plurality of collet arms longitudinally extending upwardly from the tubular member, each collet arm extending to a free distal end wherein the free distal arms define a ball seat and a retaining ring positioned to surround the free distal ends of the collet arms to as to retain the free distal ends at a radially compressed configuration, wherein the slidably tubular member is slidable between a first position wherein the retaining ring compresses the free distal ends of the plurality of collet arms and second position wherein the collet arms are disengaged from the retaining ring so as to be permitted to radially expand.

The apparatus may further comprise at least one shear pin adapted to selectably retain the slidable tubular member at the first position.

According to a further embodiment of the present invention, there is disclosed a method for selectively retaining and releasing a dropped ball within a down hole tool comprising providing a body within the down hole tool having a central passage therethrough, the central passage having an enlarged cavity section, locating a slidably tubular member having a central passage therethrough within the cavity section, providing a plurality of collet arms longitudinally extending upwardly from the tubular member, each collet arm extending to a free distal end wherein the free distal arms define a ball seat and locating a retaining ring around the free distal ends of the collet arms to as to retain the free distal ends at a radially compressed configuration, slidably displacing the tubular member from a first position wherein the retaining ring compresses the free distal ends of the plurality of collet arms and second position wherein the collet arms are disengaged from the retaining ring so as to be permitted to radially expand thereby permitting the ball to pass therethrough.

According to a further embodiment of the present invention, there is disclosed a packer setting tool comprising an inner cylinder having an inner passage extending therethrough, the inner cylinder being securable to an inner housing of the packer, an outer cylinder annularly surrounding the inner cylinder, the outer cylinder being slidably relative to the inner cylinder and having a diameter selected to longitudinally engage an outer longitudinally movable sleeve of the packer, at least one annular piston located within an annular cavity between the inner and outer cylinders, the at least one annular piston connected to the outer cylinder, at least one port extending between the inner passage and the annular cavity so as to transmit a pressure within the inner passage to the annular cavity thereby displacing the at least one annular piston and the outer cylinder in a direction towards the packer so as to bear thereupon.

According to a further embodiment of the present invention, there is disclosed a method for setting a packer comprising securing an inner cylinder having an inner passage extending therethrough, the inner cylinder being to an inner housing of the packer, slidably locating an outer cylinder annularly around the inner cylinder, the outer cylinder having a diameter selected to longitudinally engage an outer longitudinally movable sleeve of the packer, transmitting a pressurized fluid within the inner passage through the inner cylinder to an annular cavity between the inner and outer cylinders thereby displacing at least one annular piston located within the annular cavity, wherein the at least one annular piston are connected to the outer cylinder thereby displacing the at least one annular piston and the outer cylinder in a direction towards the packer so as to bear thereupon.

According to a further embodiment of the present invention, there is disclosed an apparatus for coupling a top down hole assembly to a bottom down hole assembly for removal from a well bore comprising a first pipe extending longitudinally upward from the bottom down hole assembly, a second pipe extending longitudinally downwards from the top down hole assembly sized to be received within the first pipe, an end assembly on a distal end of the first pipe assembly and a tag ring located within the first pipe coupled to the end assembly, the tag ring sized to longitudinally abut the second pipe to as to prevent the second pipe from passing therethrough.

The second pipe may includes a stinger tube extending from a bottom end thereof sized to pass through the tag ring. The tag ring may be releasably secured to the end assembly by at least one radial pin extending from the tag ring engagable within a j-shaped slot within the end assembly. The tag ring and a distal end of the second pipe may include castellations adapted to engage upon each other permitting the second pipe to rotate the tag ring out of engagement with the end assembly. The second pie may include a plurality of angularly oriented rings therearound wherein the end assembly includes a corresponding angularly oriented ring so as to permit the second pipe to be passed therethrough in a direction towards the bottom down hole assembly and prevent movement of the second pipe away from the bottom down hole assembly.

According to a further embodiment of the present invention, there is disclosed a method for coupling a top down hole assembly to a bottom down hole assembly for removal from a well bore comprising providing a first pipe extending longitudinally upward from the bottom down hole assembly, providing an end assembly on a distal end of the first pipe assembly and slidably inserting a second pipe extending longitudinally downwards from the top down hole assembly within the first pipe, abutting a distal end of the second pipe against a tag ring located within the first pipe coupled to the end assembly and rotating the second pipe relative to the first pipe so as to engage castellations on each of the distal end of the second pipe and the tag ring and disengage at least one pin from the tag ring from j-shaped slots in the end assembly.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
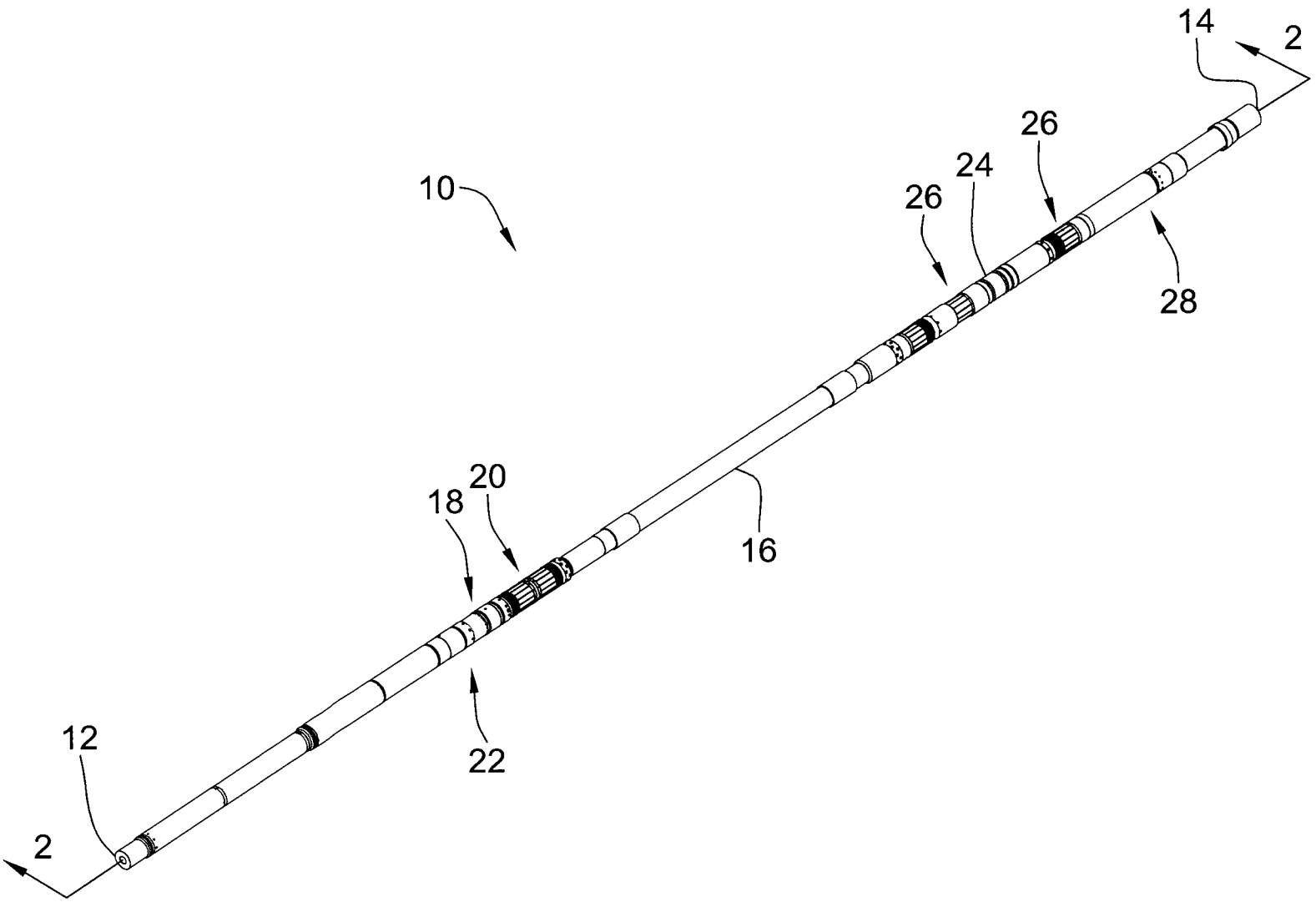
FIG. 1 is a perspective view of a casing patch assembly according to a first embodiment of the present invention.

Referring to FIG. 1, an assembly for bridging a compromised section of a down-well casing according to a first embodiment of the invention is shown generally at 10. The assembly 10 extends between first and second ends, 12 and 14, respectively and includes a central bridging pipe 16 adapted to be located within the compromised section of casing and sealed therein as will be more fully described below. The bridging pipe 16 of the apparatus 10 includes a first seal 18 and first pair of gripping collet arms 20 located proximate to a first end 22 thereof and a second seal 24 and a second pair of gripping collet arms 26 located proximate to a second end 28 thereof. In operation, the first and second collet arms and seals are extended into engagement with the casing after the bridging pipe portion is located in the desired location so as to seal the compromised portion of the pipe and repair any perforations or ruptures therein.

Turning now to FIGS. 2 through 20, a cross sectional view of the assembly of FIG. 1 is shown. The assembly includes a bridging pipe 16 having an inner pipe assembly 80 extending through in interior thereof. As illustrated in greater detail in FIG. 3, the assembly includes a setting tool 40 at the first end thereof. The setting tool 40 includes the first end 12 of the assembly which may include an internal threading for connection to a tool string as is commonly known. The setting tool is adapted to utilize pressure within the tool string or the annulus between the tool string and the casing to extend the seals into engagement with the casing.

Figure 3:
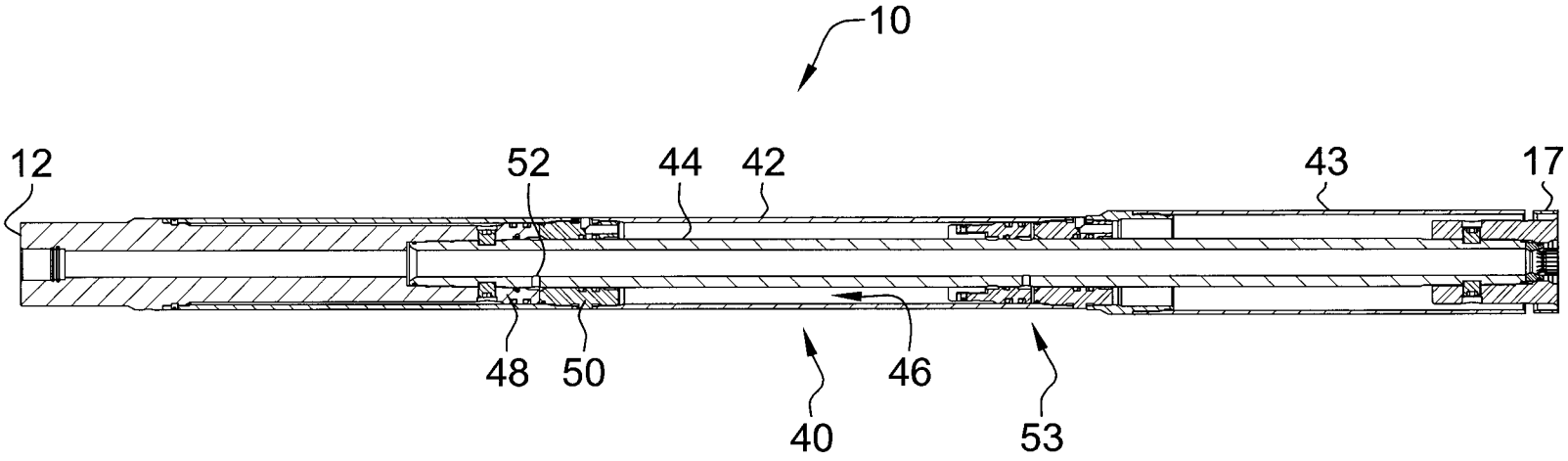
FIG. 3 is a detailed cross sectional view of the setting tool for use in the casing patch assembly of FIG. 1.
Figure 10:
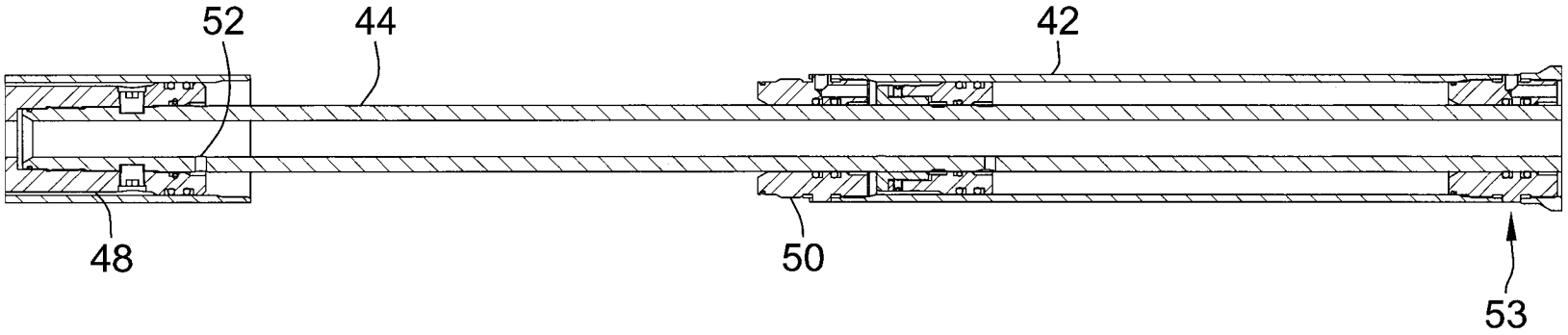
FIG. 10 is detailed cross sectional view of the setting tool for use in the casing patch assembly of FIG. 1 at a second or extended position.

As shown in FIGS. 3 and 10, the setting tool 40 comprises an outer tubular portion 42 and an inner tubular portion 44 forming an annular chamber 46 therebetween. The annular chamber 46 is sealed at the leading edge by an end body 48 of the setting tool and includes an annular piston 50 therein. The annular piston 50 is operably connected to the outer tubular portion 42 and slidably sealed to the inner tubular portion 44. A passage 52 extends between the interior of the inner tubular portion 44 and a boundary between the annular piston 50 and the end body 48 so as to convey pressure within the interior of the tool string therebetween. In operation when a user desires to extend the seals, an increasing pressure is applied to the interior of the tool string so as to pressurize the location between the annular piston 50 and the end body 48 so as to move the annular piston 50 and thereby the outer tubular portion 42 in a direction towards the second end 14 of the assembly. Details of the extension of such seals will be provided further below. As illustrated in FIG. 3, the setting tool 40 may include a second set of pistons generally indicated at 53 secured to each of the inner tubular portion 44 and outer tubular portion 42 so as to increase the force which the setting tool may apply. As illustrated in FIG. 3, the setting tool includes a transfer sleeve 43 sized to correspond to the matching first end sleeve 17 of the bridging pipe 16.

Figure 4:
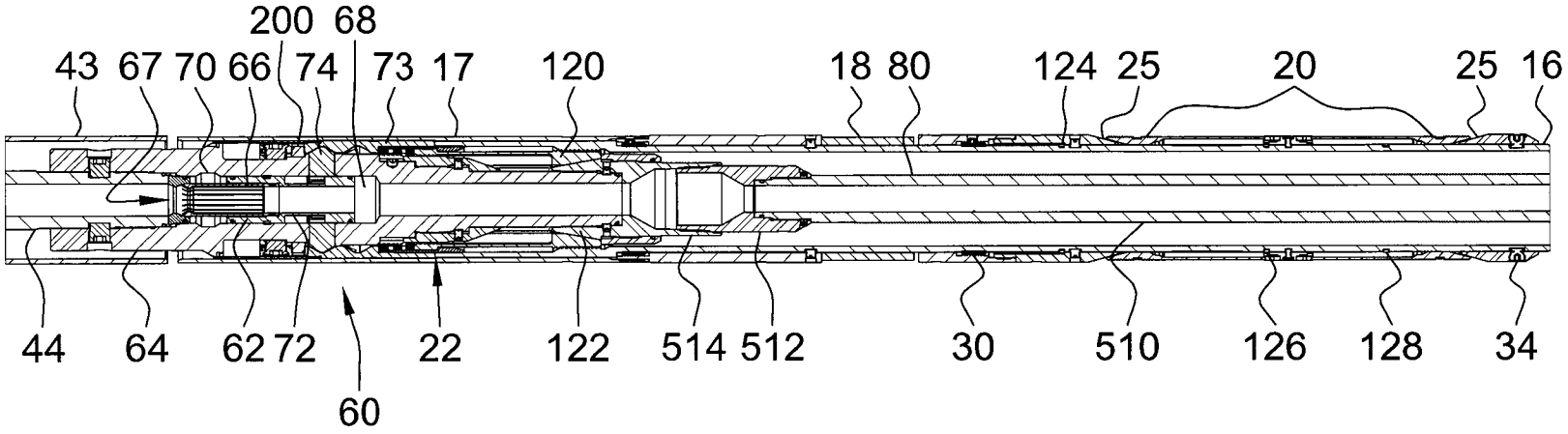
FIG. 4 is a detailed cross sectional view of the top seal and running tool for use in the casing patch assembly of FIG. 1 at a first or run in position.
Figure 11:
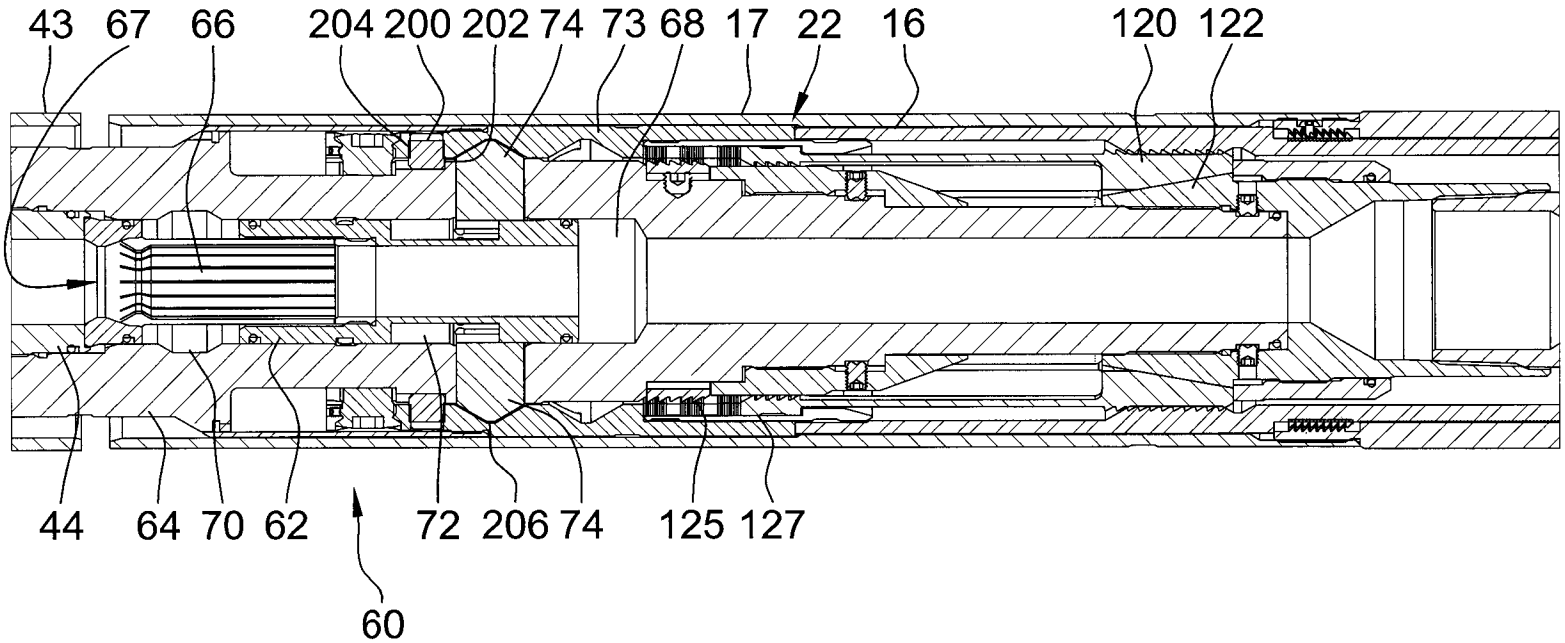
FIG. 11 is a detailed cross sectional view of the running tool for use in the casing patch assembly of FIG. 1 at a first or run in position.
Figure 12:
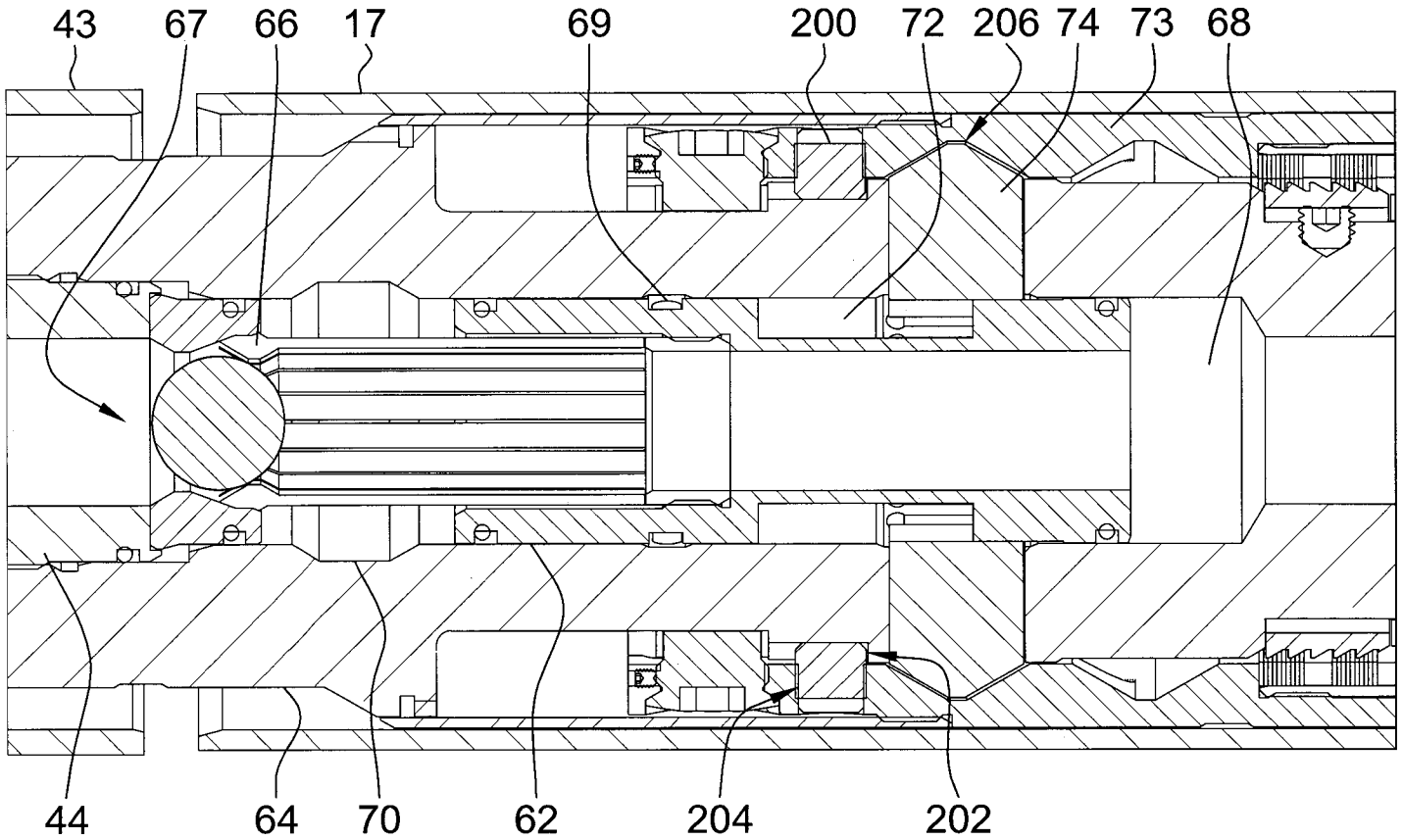
FIG. 12 is detailed cross sectional view of the running tool for use in the casing patch assembly of FIG. 1 at a second position with a ball engaged upon the ball seat.
Figure 13:
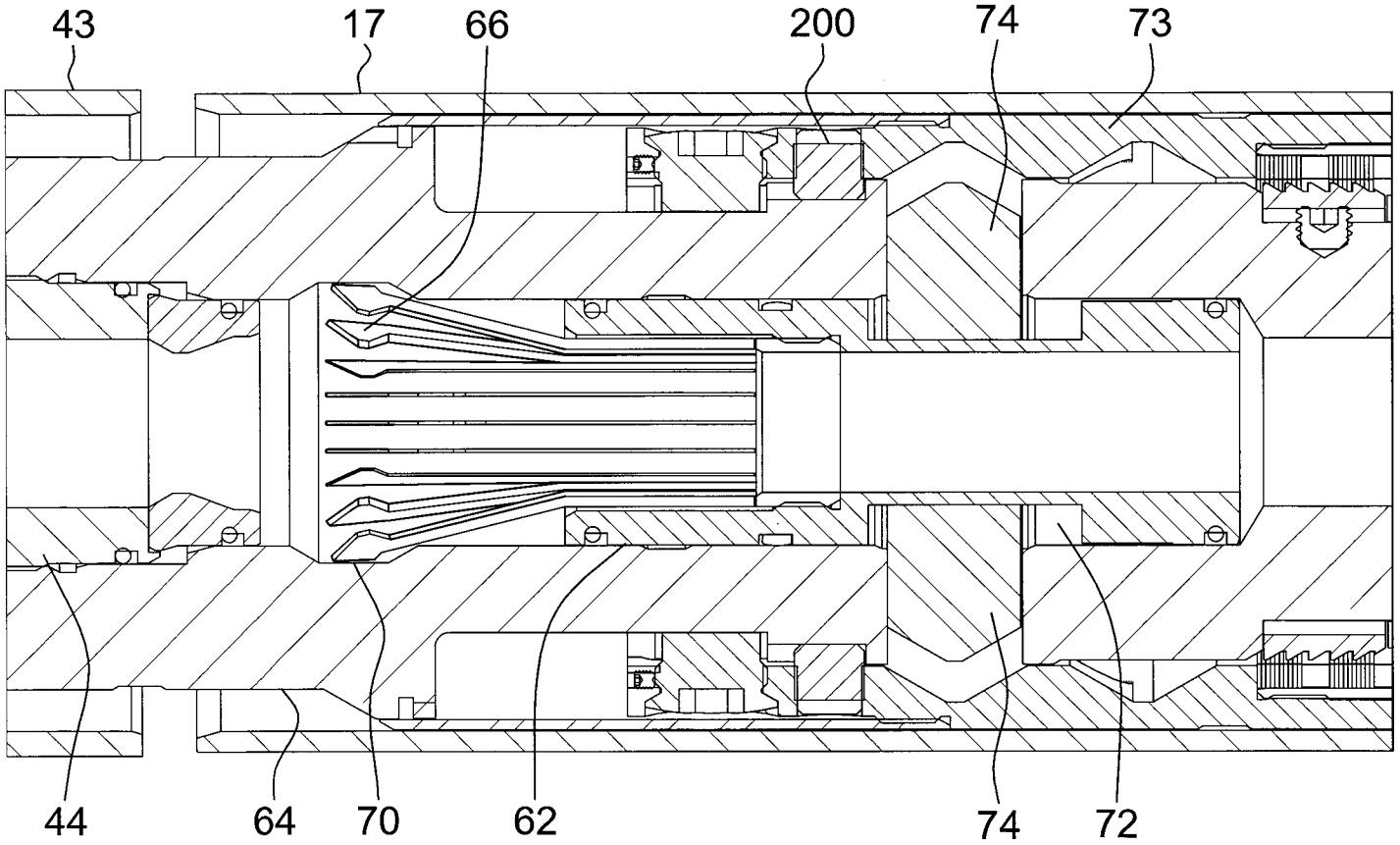
FIG. 13 is detailed cross sectional view of the running tool for use in the casing patch assembly of FIG. 1 at a third or release position shifted down to expand the collet arms and release the ball.
Figure 21:
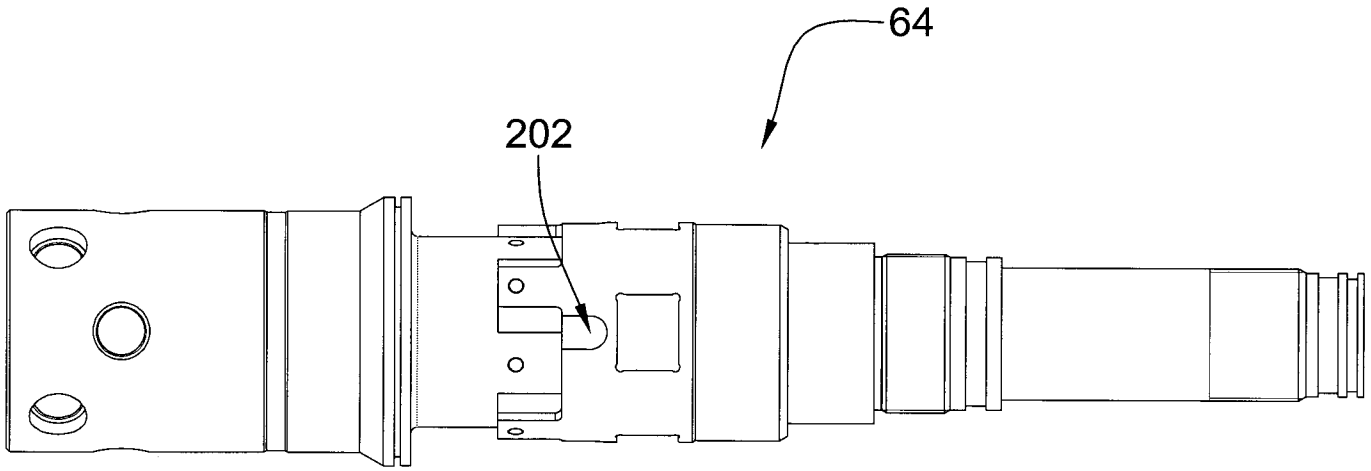
FIG. 21 is detailed side view of the ball seat body showing the passages for passing the shear release pins.
Figure 22:
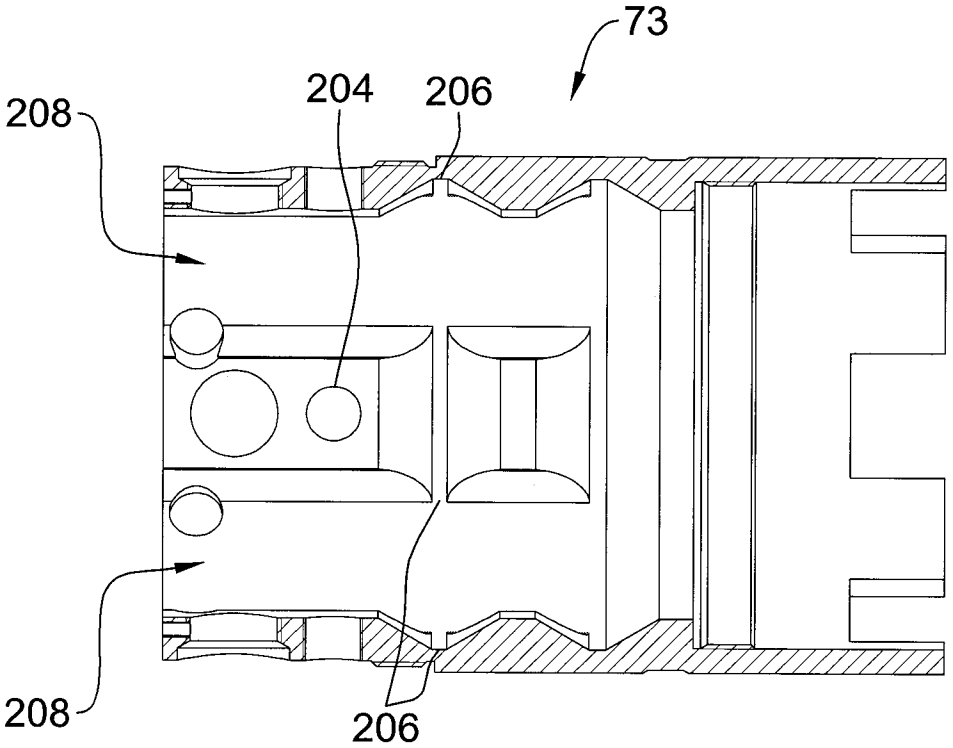
FIG. 22 is detailed cross sectional view of the upper collet sleeve for use in the casing patch assembly of FIG. 1.
Figure 27:
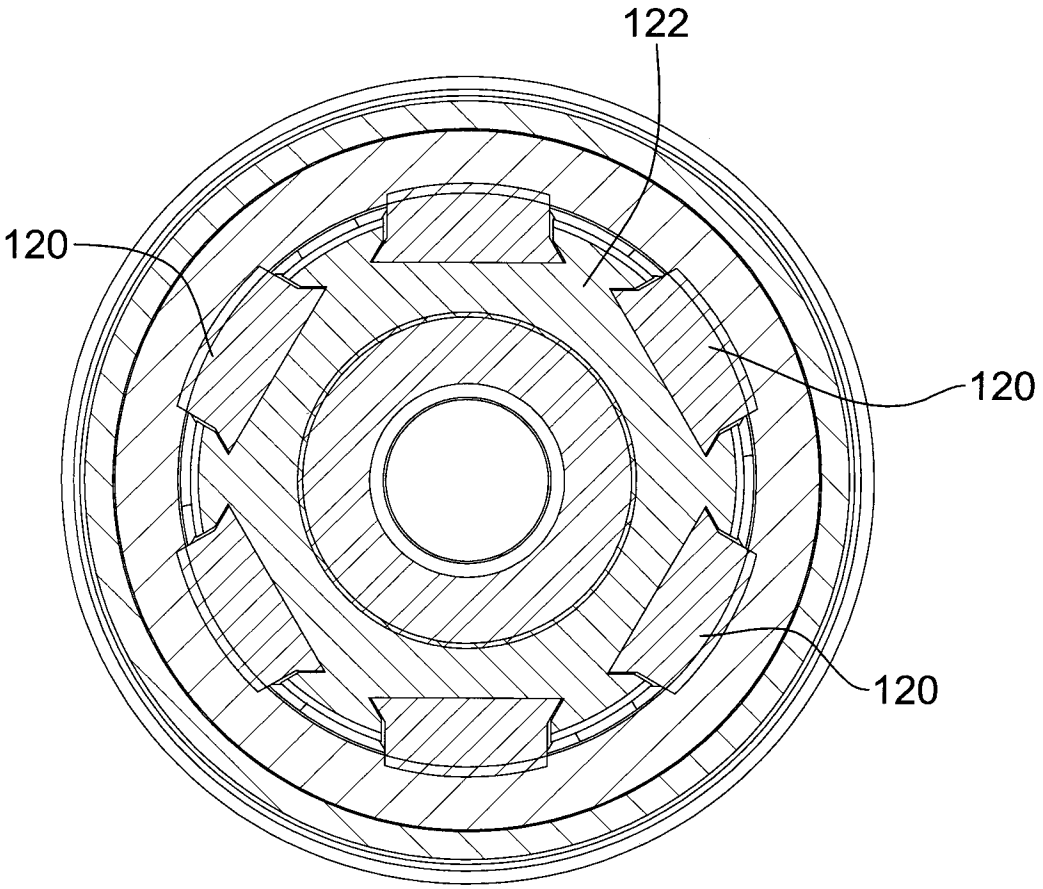
FIG. 27 is detailed cross sectional view of the release collet arms of the running tool.

Turning now to FIGS. 4 and 11, a detailed view of an auto tripping ball seat 60 for forming the desired pressure within the setting tool 40 is illustrated. The auto tripping ball seat 60 is secured to the inner tubular portion 44 of the setting tool so as to be run into and retrieved from the well as a single component. In particular, the auto tripping ball seat 60 may comprise an upper slidable tubular member 62 located within a ball seat body 64. The upper slidable tubular member 62 includes a plurality of collet arms 66 at a leading edge thereof forming a ball seat 67 at a leading edge of the slidable tubular member 62. The upper slidable tubular member 62 is sealably secured within a cavity 68 in the ball seat body 64 by set screws or the like and the collet arms 66 are adapted to be retained in the reduced orientation as shown to retain a dropped ball by engagement upon the cavity 68 as illustrated in FIG. 12. The cavity 68 includes an expanded portion 70 downstream of the initial position of the collet arms 66 such that at a sufficiently high enough pressure, the set screws 69 will be broken and the upper slidable tubular member 62 is permitted to shift in a direction towards the second end 14 of the assembly thereby also permitting the collet arms to expand and release the ball to pass therethrough as illustrated in FIG. 13. The upper slidable tubular member 62 also includes an annular recess 72 in an exterior thereof wherein the ball seat body 64 include a plurality of keys 74 extending therethrough into engagement with an upper collet sleeve 73 inside the first end sleeve 17 and engages upon the first end 22 of the bridging pipe 16. As the upper slidable tubular member 62 shifts toward the second end 14 of the assembly 10, the keys 74 are permitted to retract into the annular recess 72 and out of engagement with the upper collet sleeve 73 thereby decoupling the ball seat body from the upper collet sleeve 73 and bridging pipe 16. As a safety precaution if sufficient pressure does not shift the ball seat downwardly, the setting tool may be rotated to shear release pins 200 thereby releasing collet arms 120. As illustrated in FIGS. 21 and 22, the shear release pins 200 pass through bores 202 in the ball seat body 64 and bores 204 in the upper collet sleeve 73. The shear release pins 200 prevent rotation between the ball seat body 64 and the upper collet sleeve 73 thereby retaining the keys 74 within notches 206 in the upper collet sleeve 73. Upon shearing of the shear release pins 200, the keys 74 may be rotated into enlarged portions 208 in the bore of the upper collet sleeve 73 thereby permitting longitudinal movement therebetween. As illustrated in FIG. 27, the release collet arms 120 may have a dovetailed profile received within corresponding dovetail slots on the cone so as to retract the release collet arms 120 as the cone is moved down hole.

Figure 5:
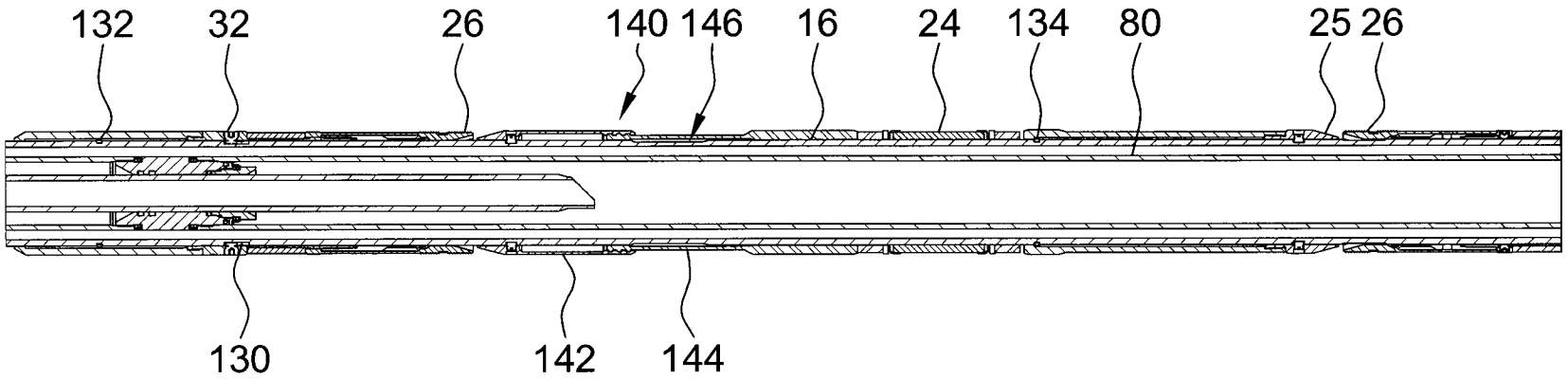
FIG. 5 is a detailed cross sectional view of a middle portion and a portion of the bottom seal of the casing patch assembly of FIG. 1 at a first or run in position.
Figure 6:
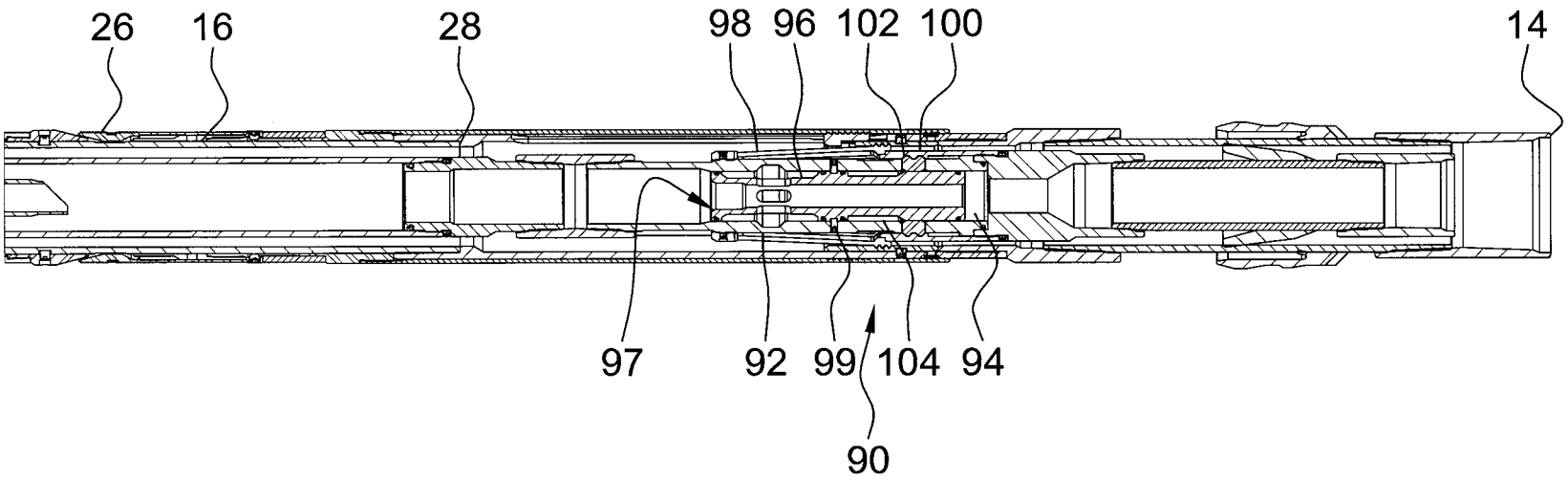
FIG. 6 is a detailed cross sectional view of a portion of the bottom seal and release tool for use in the casing patch assembly of FIG. 1 at a first or run in position.

As illustrated in FIGS. 4 and 5, the assembly includes an inner pipe assembly 80 extending between the ball seat body 64 and the release apparatus 90 as will be more fully described below. The inner pipe assembly 80 ensures that the entire contents of the interior of the bridging pipe 16 may be removed after setting the bridging pipe. With reference to FIG. 6, the release apparatus 90 is illustrated which includes the second end 14 of the assembly. The release apparatus 90 includes a release body 92 extending from and connected to the inner pipe assembly 80. The release body forms an inner passage having a bottom cavity 94 adapted to sealably receive a lower tubular sliding member 96 therein. The lower tubular sliding member 96 includes a ball catch surface 97 at a leading edge thereof adapted to receive and retain a dropped ball thereon. The lower tubular sliding member 96 is secured to the release body 92 through the use of shear pins 99.

As illustrated in FIG. 6 the release apparatus 90 further includes a plurality of retaining arms 98 extending from the release body 92 into engagement with the interior of the bridging pipe 16 which are retained in engagement therewith by a backing body 100. The backing body 100 is slidably located around the release body 92 and secured thereto with a plurality of lower keys 102 or the like. The lower keys 102 are retained in such engagement by the lower tubular sliding member. As illustrated in FIG. 6, the lower tubular sliding member 96 includes an annular recess 104 therein adapted to release the lower keys 102 from engagement with the backing body 100. In operation, a sufficiently high enough pressure applied to a ball on the lower tubular sliding member 96 will rupture or shear the shear pins 99 thereby allowing the lower tubular sliding member 96 to shift towards the second end 14 of the assembly. If the ball cannot seat on the bottom seat due to damage from the first seat or any other reason, then a second larger ball can be dropped to land in ball catch surface 97. At such position, the lower keys 102 will be permitted to retract into the annular recess 104 thereby disengaging the release body 92 from the backing body 100 and thereby permitting any movement of the inner pipe assembly 80 and therefore the release body 92 in a direction towards the first end 12 of the assembly to disengage the retaining arms 98 from the bridging pipe 16. After such disengagement, the release apparatus 90 may be removed from the interior of the bridging pipe 16 along with the inner pipe assembly 80. If pressure cannot shear pins 99 and the release apparatus 90 then an over pull condition may be applied to shear a weakened location on the collet arms 98 that will allow the inner pipe assembly 80 and release apparatus 90 to be pulled out of the hole.

Figure 7:
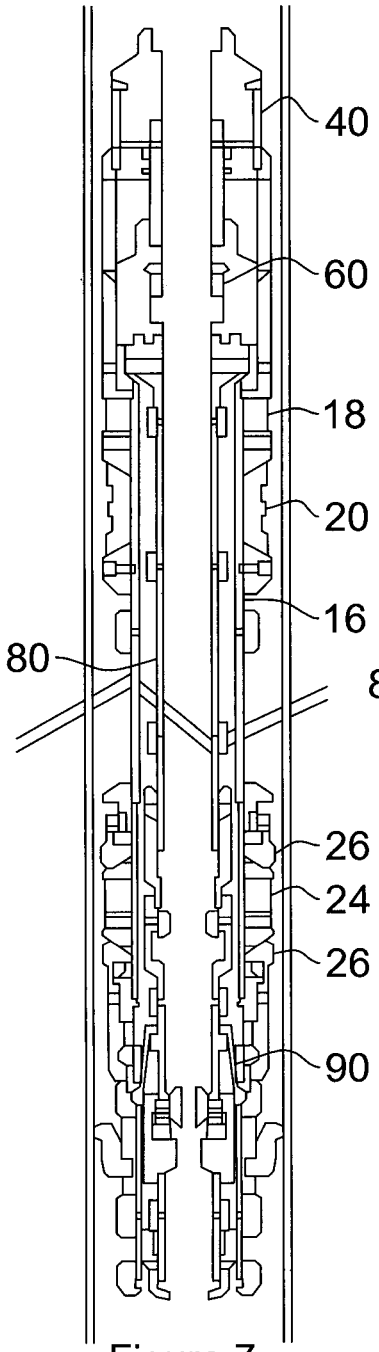
FIG. 7 is an illustration of an assembly for patching a casing according to a further embodiment at a first or run in position.
Figure 8:
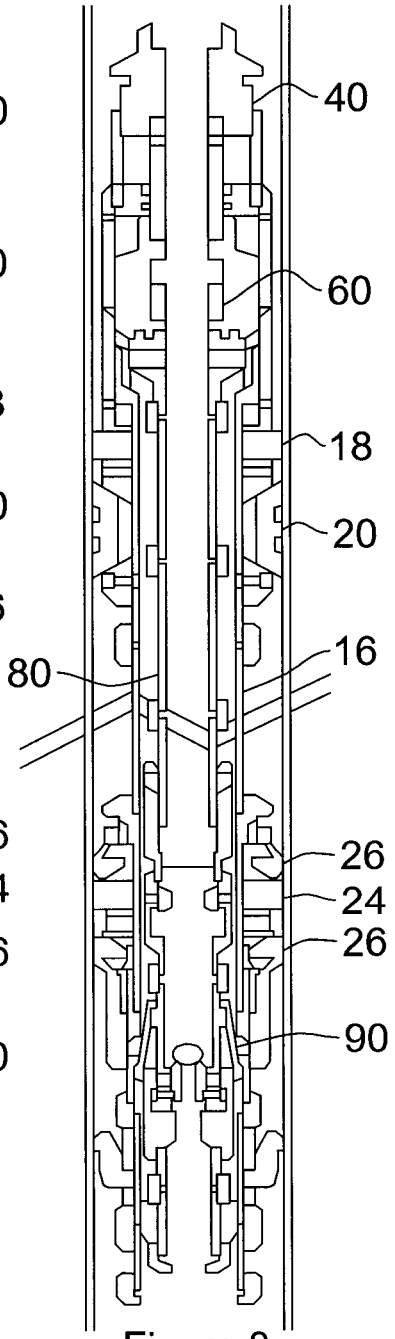
FIG. 8 is an illustration of the assembly of FIG. 7 at a second or setting position.
Figure 9:
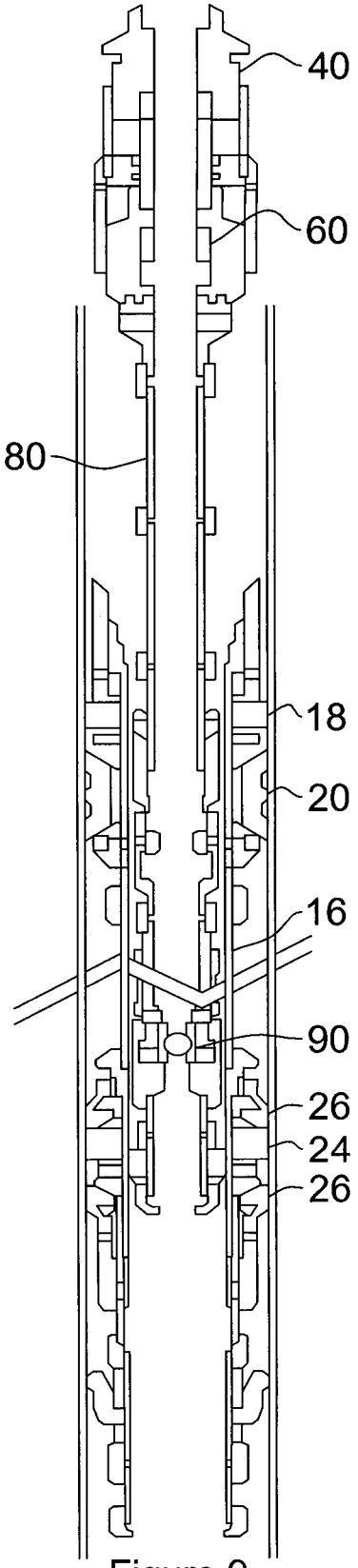
FIG. 9 is an illustration of the assembly of FIG. 7 at a third or released position.

Turning now to FIGS. 7 through 9, a sequence of operation for utilizing the assembly is illustrated. In operation, the assembly 10 may be located within a ruptured casing with the first and second seals 18 and 24 to either side thereof. To extend the seals, a ball may be dropped down the tool string to engage upon the ball seat 67 on the first slidable tubular member 62. Applying pressure to the tool string will urge the annular piston 50 and the end body 48 apart until the transfer sleeve 43 engages the bridging pipe 16. As the inner pipe assembly 80 and thereby the release apparatus are connected to the second end 28 of the bridging pipe 16, such engagement and further movement will urge the top edge of the bridging pipe 16 in a direction towards the second end 14 of the assembly and extend the first seal 18 and gripping collet arms 20.

After the first seal 18 has been set, further increasing the pressure within the tool string will thereafter shear the set screws between the first slidable tubular member 62 and the ball seat body 64 thereby permitting the first slidable tubular member to shift as set out above which will release the ball to pass therethrough to the lower tubular sliding tubular member 96.

Furthermore, a downward force upon the setting tool 40 towards the second end 14 of the apparatus will further cause the collets arms 120 to retract from engagement with the bridging pipe 16.

Figure 17:
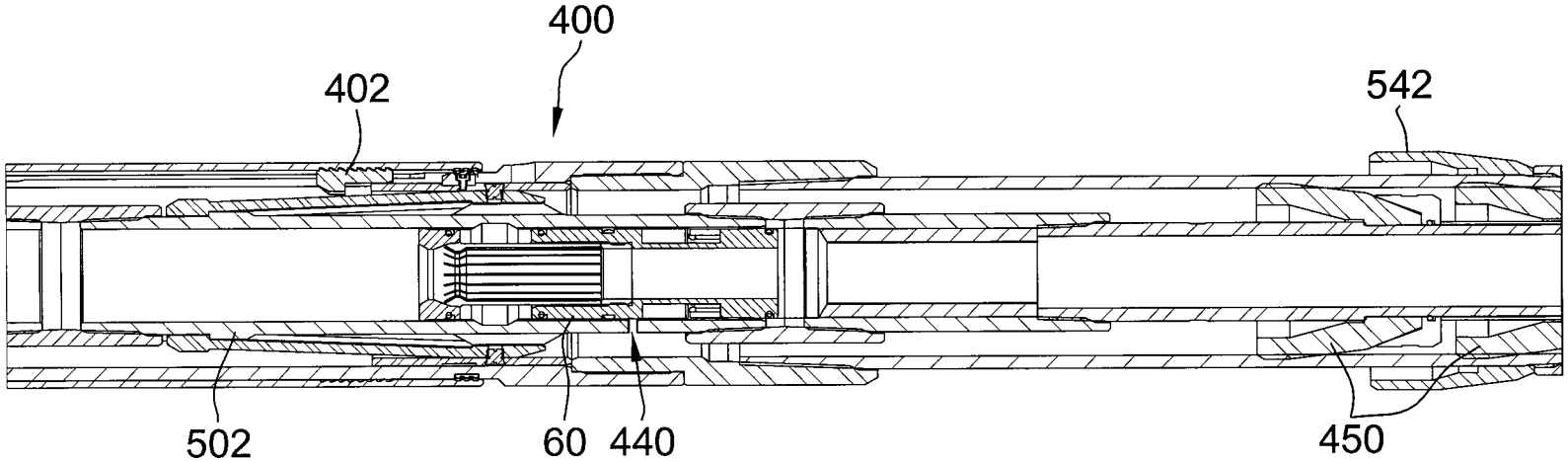
FIG. 17 is a detailed cross sectional view of the release tool for use in the casing patch assembly of FIG. 1 according to a further embodiment of the present invention at a first or run in position.

As illustrated in FIG. 17, a bottom seal activation assembly 400 may include a release mechanism in an alternative embodiment to the release mechanism 90 shown in FIG. 6. The bottom seal activation assembly 400 may include a further auto tripping ball seat 60 as set out above for providing a second extending force to the setting tool. It will be appreciated that the second auto tripping ball seat 60 may be located at any location within the assembly so as to provide a pressure increase thereto. Additionally, it will be appreciated that at such time, the retrieval collet arms 120 will have been disengaged from the bridging pipe 16 so as to permit inner pipe assembly 80 to move relative to the bridging pipe 16. Accordingly pressuring the annular chamber 46 will pull upward on the inner pipe assembly 80 relative to the bridging pipe 16 which is secured at the first seal 18 to the well bore.

Figure 18:
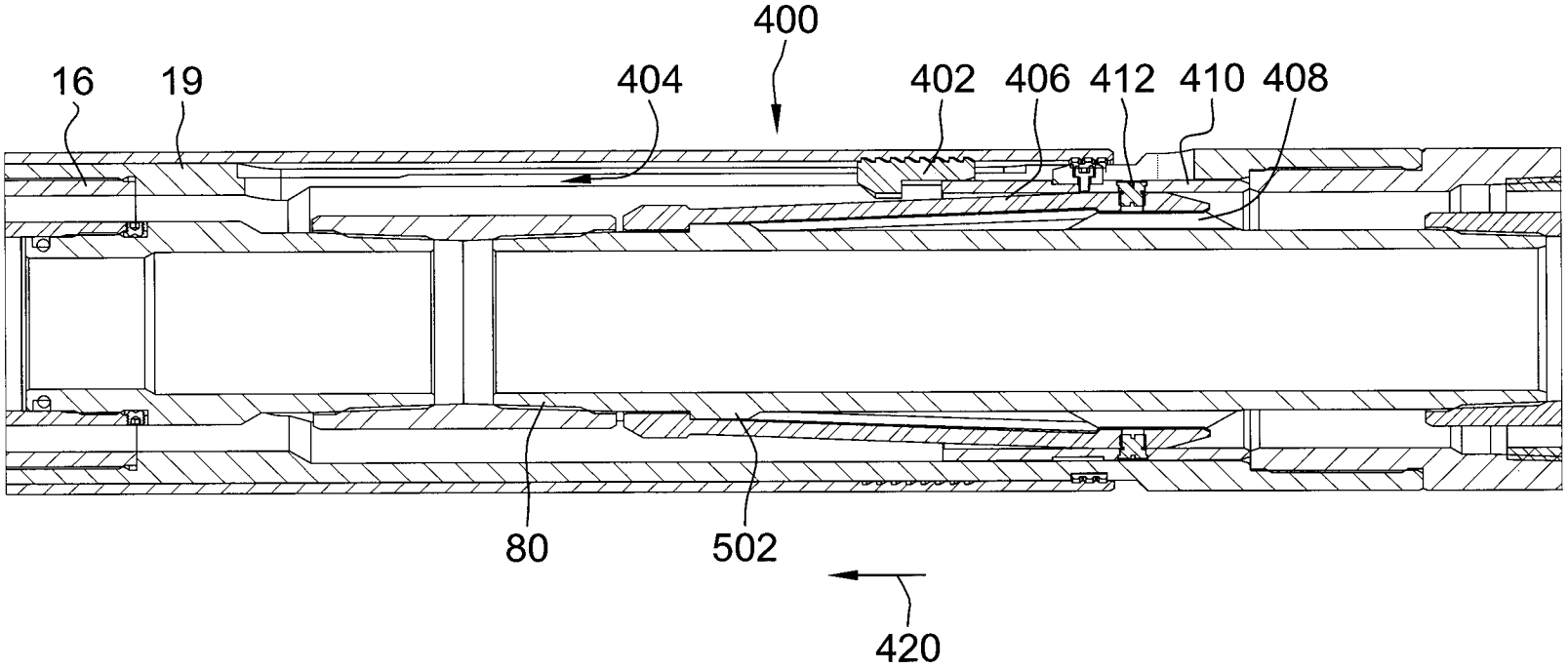
FIG. 18 is a detailed cross sectional view of the release tool of FIG. 17 with the shifting release sleeve removed for clarity at the first position.
Figure 19:
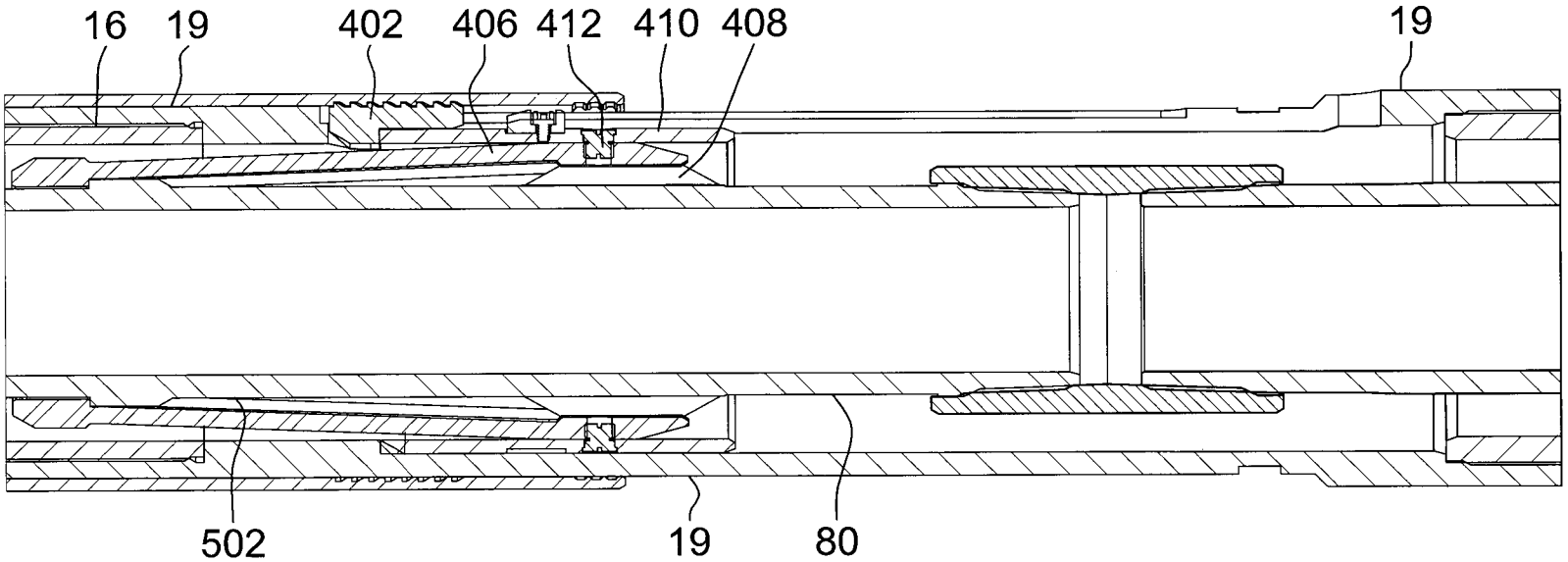
FIG. 19 is a detailed cross sectional view of the release tool of FIG. 17 with the shifting release sleeve removed for clarity at a second or activated position.
Figure 20:
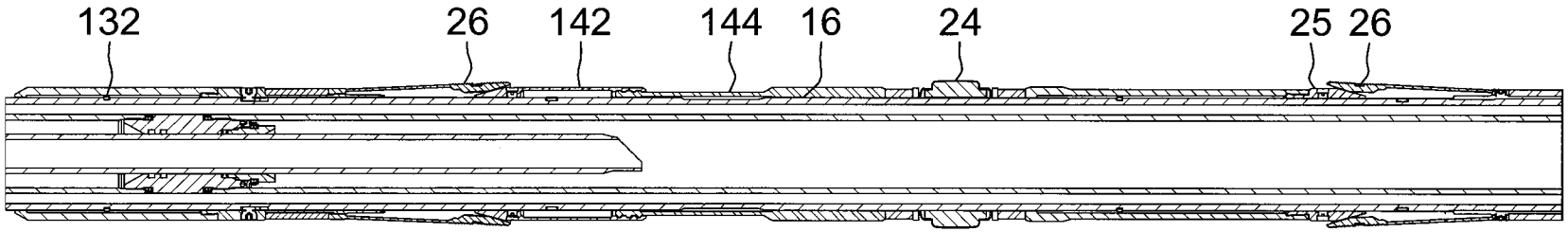
FIG. 20 is a detailed cross sectional view of the second seal for use in the casing patch assembly of FIG. 1 at a second or extended position.

As illustrated in FIG. 18, the bottom seal activation assembly 400 is included proximate to the second end 14 of the bridging pipe 16. The bottom seal activation assembly 400 includes a plurality of carriages 402 located within slots 404 through a bottom pipe extension 19, extending from the second end 28 of the bridging pipe 16. The inner pipe assembly 80 includes a plurality of pulling arms 406 extending therefrom which are spaced annularly around the inner pipe assembly 80 with splines 408 therebetween. The pulling arms 406 are secured to a pulling sleeve 410 with shear pins 412. As the inner pipe assembly 80 pulls upwardly in a direction generally indicated at 420, the pulling arms 406 pull upwardly on the pulling sleeve 410 to engage upon the carriages 402 which are then moved through the slots 404 to extend the second seal 24 and second pair of gripping collet arms 26 as set out below.

Thereafter further increasing the pressure through the tool string will again urge the annular piston 50 (as shown in FIGS. 3 and 10) and the end body 48 apart so as to pull upward on the inner tubular portion 44 against the first pair of collet arms 20. Such movement of the inner tubular portion 44 will act through the inner pipe assembly 80 so at to pull upward on the second end 28 of the bridging pipe 16. Such upward movement of the second end 28 of the bridging pipe 16 will compress the bridging pipe 16 so as to extend the second seal 24 and second pair of gripping collet arms 26 into engagement with the casing. At such time a test pressure may be applied to the annulus between the tool string and the casing to test the integrity of the seals. As illustrated in FIG. 17, the bottom portion of the assembly may include inner packer cups 450 and outer packer cups 542 adapted to seal the annulus of the well bore to the assembly 10 as well as seal the bridging pipe 16 to the inner pipe assembly 80 thereby permitting such pressure test.

After the seals have been verified, the pressure within the annulus may be reduced and the pressure within the tool string again increased to shear the shear pins of the lower tubular sliding member 96. After such shear pins have been sheared, the release apparatus and therefore the inner pipe and setting tool may be removed from the bridging pipe.

In operation, the first and second pairs of gripping collet arms 20 and 26 are extended by cones 25 which are urged under the ends of the pairs of gripping collet arms 20 and 26. Each of the cones, and collet arms are initially secured to the bridging pipe by set screws which are sheared as the bridging pipe is compressed by the setting tool. The first end of the bridging pipe 16 is indexed to the first pair of gripping collet arms 20 by a ratchet 30 therebetween to permit movement therebetween caused by the shifting tool, but not thereafter whereas the bottom most cone is secured to the bridging pipe 16 by a larger set screw 34 selected to remain in place after setting of the collet arms. Furthermore, the second pair of gripping collet arms 26 are retained in position by a larger set screw 32 as illustrated in FIG. 5 which will maintain the second pair of gripping collet arms 26 at a position along the bridging pipe 16 until a sufficiently large enough thermal expansion force is applied to the bridging pipe whereafter they will be sheared permitting the second pair of gripping collet arms 26 and second seal to float along the bridging pipe so as to permit thermal expansion of the bridging pipe 16.

Figure 14:
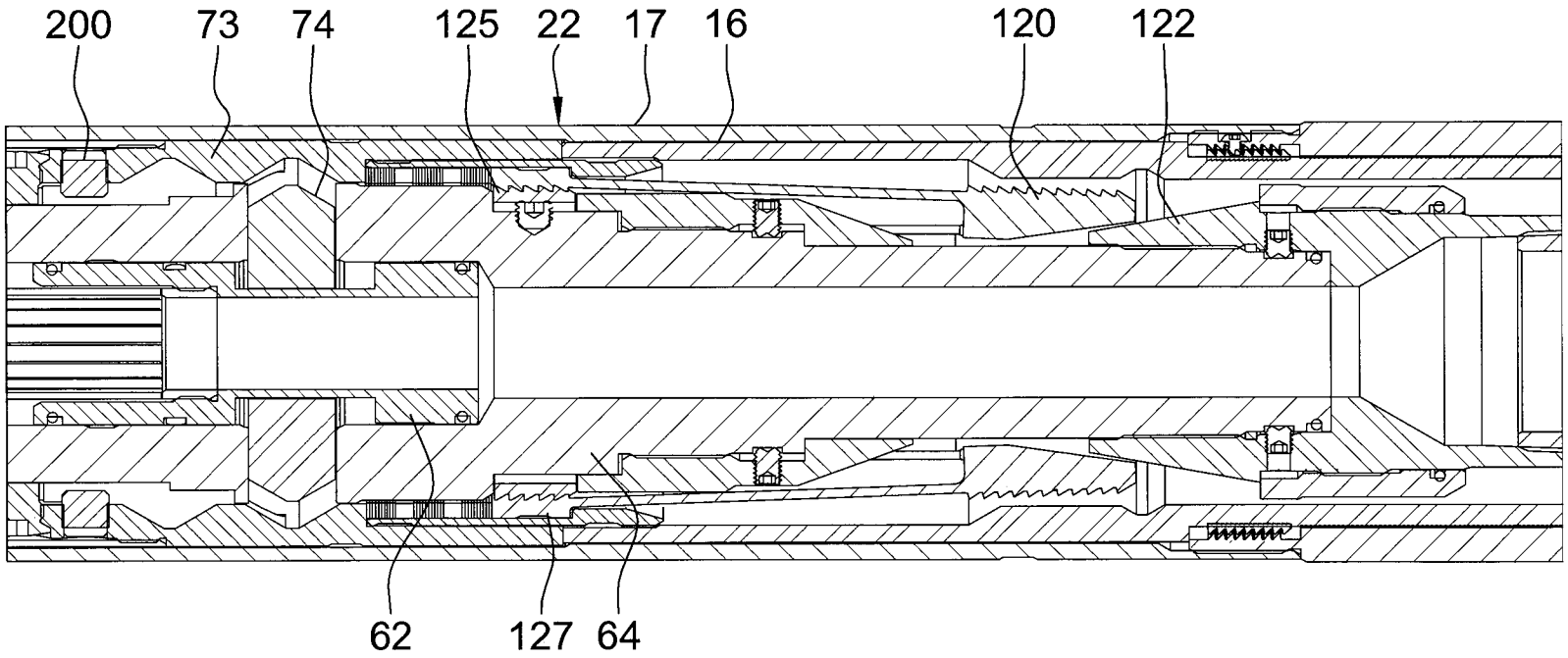
FIG. 14 is detailed cross sectional view of the collet arms of the running tool for use in the casing patch assembly of FIG. 1 at the third or release position.
Figure 15:
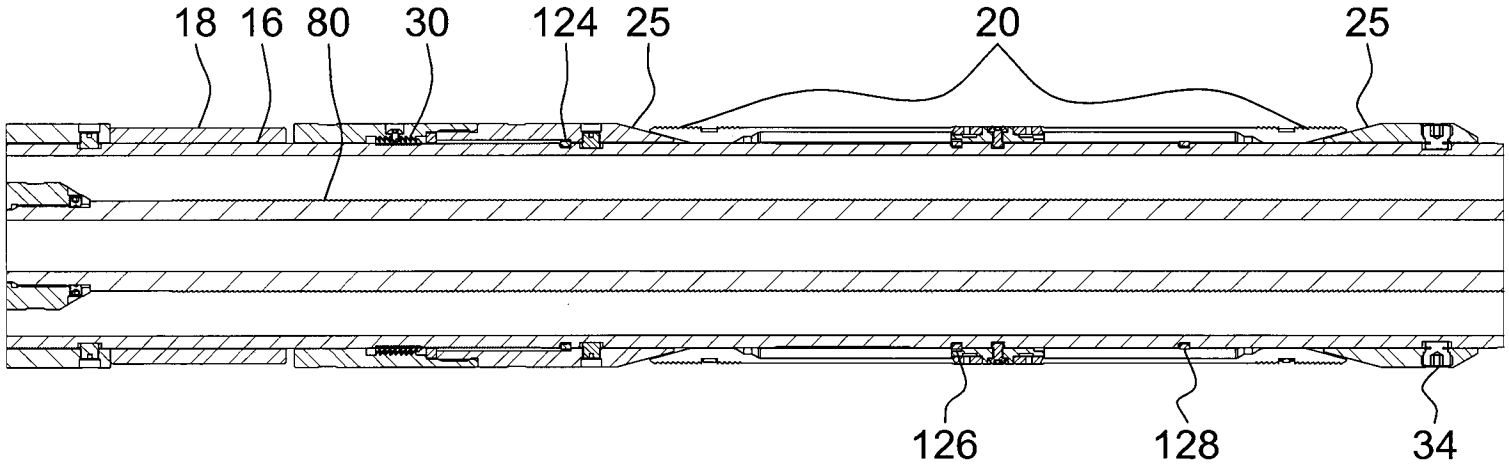
FIG. 15 is a detailed cross sectional view of the top seal for use in the casing patch assembly of FIG. 1 at a first or run in position.
Figure 16:
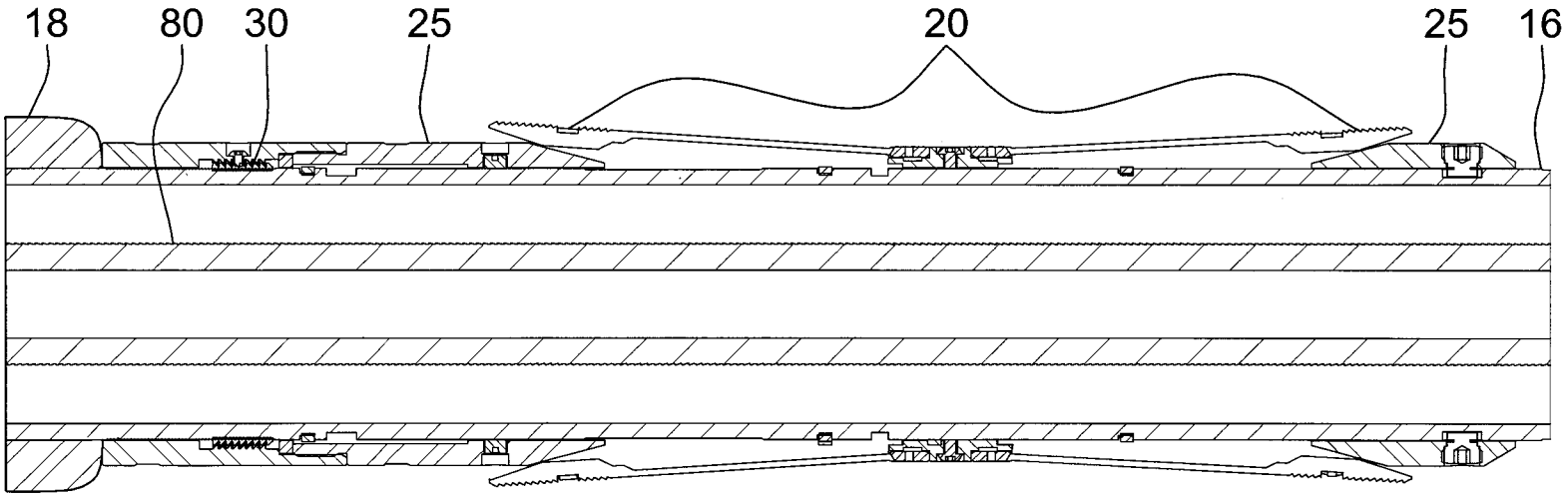
FIG. 16 is a detailed cross sectional view of the top seal for use in the casing patch assembly of FIG. 1 at a second or expanded position.

After being set in place the setting tool 40 and release apparatus 90 can be removed from the bridging pipe 16 to permit operation of the well again as set out above. When the bridging pipe 16 is desired to be removed, the setting tool including the auto tripping ball seat 60 can again be run into the well bore to engage and release the collet arms. The setting tool 40 includes a downwardly oriented a retrieval ring 125 at a position adapted to engage upon retrieval grips 127 on the release collet arms 120 as illustrated in FIGS. 11 and 14. After the top seal has been set, upward motion of the inner pipe assembly 80 as set out above will pull the release collet arms 120 out of the bridging pipe as well wherein the retrieval ring 125 prevents the release collet arms 120 from moving relative to the cone 122 so as to prevent them from re-engaging upon the bridging pipe 16.

After being located within the bridging pipe 16, a ball may again be dropped to be located on the ball seat 67 so as to cause the inner tubular portion 44 to be moved upward relative to the outer tubular portion 42 as set out above. In order to remove the bridging pipe, the auto tripping ball seat 60 with release collet arms 120 at the initial position may be inserted into the well bore so as to engage the release collet arms 120 upon the bridging pipe as illustrated in in FIG. 11. Thereafter an upward force may be applied to the auto tripping ball seat 60 so as to pull upwardly on the bridging pipe 16.

Thereafter, this movement caused by the pressurized working string along with an upward force applied to the top end of the work string will further engage the retrieval collet arms 120 in the bridging pipe and pull it upwardly out of the well bore. The upward motion of the bridging pipe 16 will initially shear the larger set screw 34 securing the bottom cone on bridging pipe to release this cone therefrom. The bridging pipe includes first second and third retrieval rings 124, 126 and 128, respectively each adapted to engage and pull upwardly on the topmost cone, the top collet arm and bottom collet arm, respectively. The upward motion of the bridging pipe thereafter will engage the first second and third retrieval rings 124, 126 and 128 in order thereby removing the cones 25 and collet arms 20 in sequence. Advantageously, the first second and third retrieval rings 124, 126 and 128 are positioned around the bridging pipe so as to engage the top cone first, the top collet second and the bottom collet third so as to space such components along the bridging pipe as they are pulled out of the well.

After the top collets and seal have been released, the bottom collets and seals may then also be released. If the larger set screw 32 has not yet been sheared by thermal cycling of the upward motion of the bridging pipe 16 will then shear such set screw. Optionally the larger set screw 32 may be received within a slot 130 in the bridging pipe so as to permit the larger set screw 32 to be sheared at a different time than the larger set screw 34 above so as to reduce the total force required. Similar to the top collets and seal above, the bridging pipe 16 includes first and second retrieval rings 132 and 134 respectively for pulling upwardly on the topmost collet arms as well as upwardly on the bottom most cone. The bridging pipe also includes a compression sleeve 140 between the topmost cone and the seal 24. The compression sleeve 140 comprises inner and outer arms 144 and 142, respectively interlocked with each other. The bridging pipe 16 includes a recess 146 just below the interlock such that upward movement of the bridging pipe permits the inner arms to radially move inward and therefore out of engagement with the outer arms. This will then permit the compression sleeve 140 to compress and therefore permit the topmost cone to slip downwardly out from under the collet arms thereby disengaging them from the well bore. As set out above, the first and second retrieval arms 132 and 134 are spaced apart by a distance to space all components along the bridging pipe.

Figure 2:
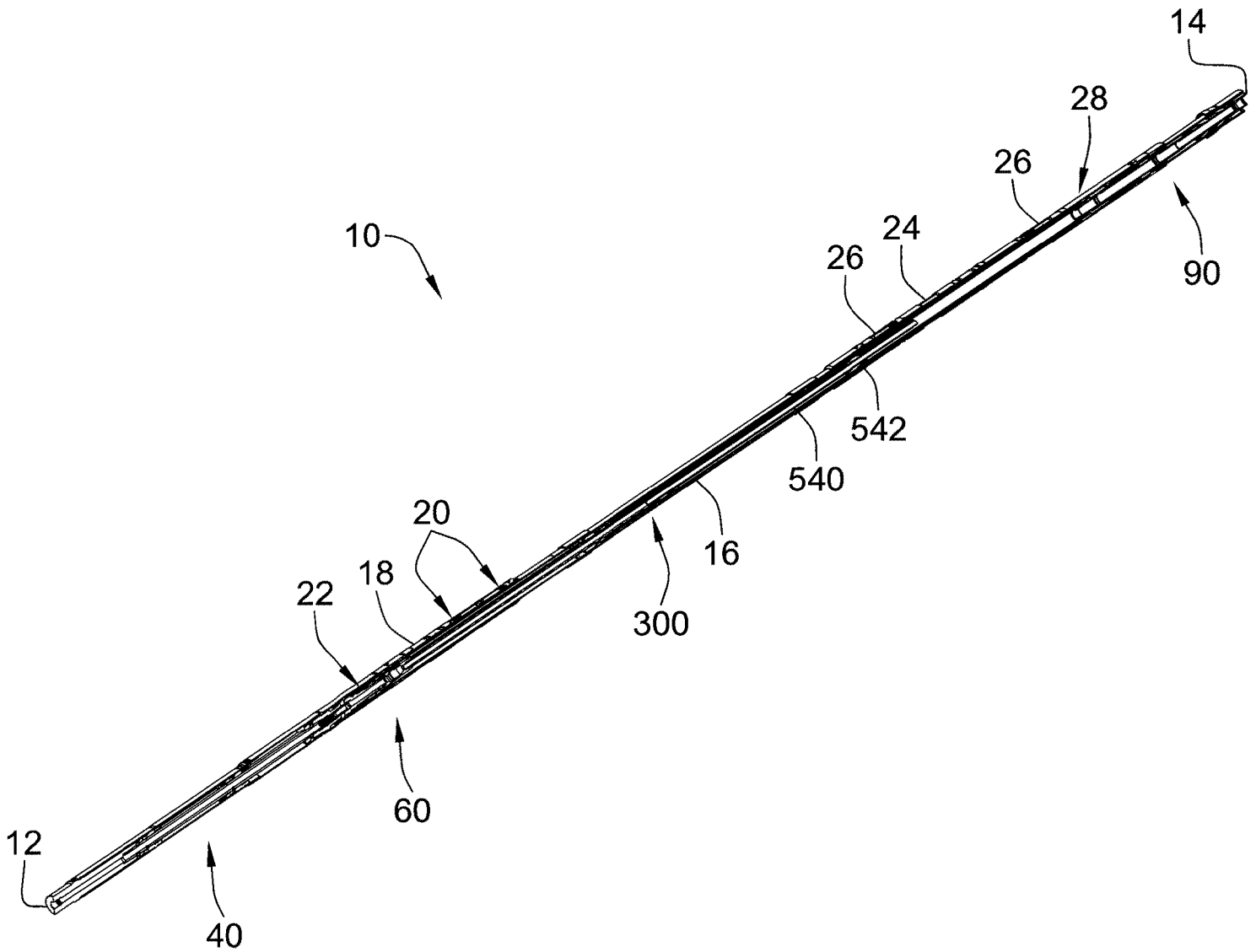
FIG. 2 is a cross sectional view of the casing patch assembly of FIG. 1 as taken along the line 2-2.
Figure 26:
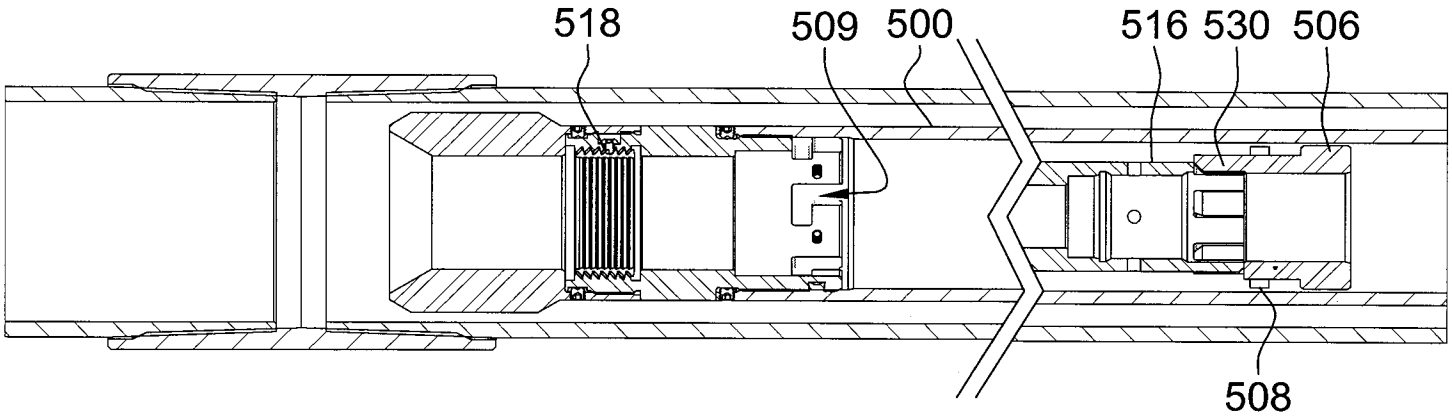
FIG. 26 is detailed cross sectional view of the end assembly of FIG. 25 with the connection pipe engaged in the tag ring and removed from the end assembly.

As illustrated in FIG. 2 and described above, the inner pipe assembly 80 bridges the bottom portion of the present apparatus to the top portion so as to transmit movement therebetween as set out above. The inner pipe assembly 80 comprises a first pipe 500 extending from a bottom pipe base 502 adapted to form an inner base for the release apparatus 90. The first pipe 500 extends to a distal end having an end assembly 502 thereon. The end assembly comprises and end collar 504 and a selectably releasable tag ring 506 releasably secured to said end assembly within the first pipe 500. As illustrated in FIG. 26, the tag ring 506 includes a plurality of radially extending pins 508 therefrom which are adapted to be engaged within j-shaped slots 509 in the end collar 504 and rotated therein so as to secure the tag ring therein.

Figure 25:
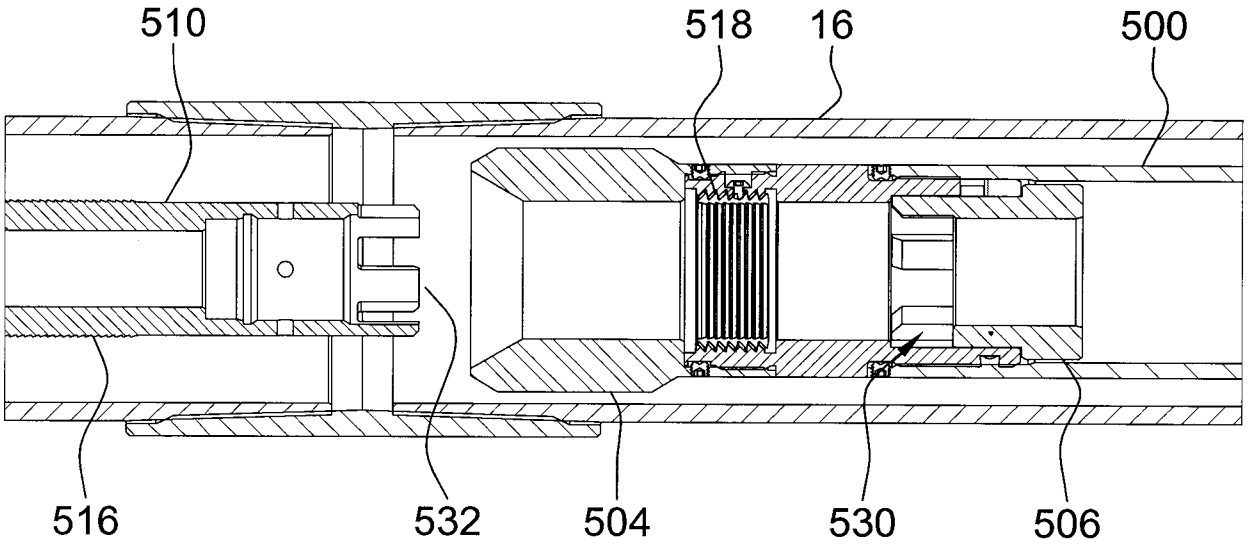
FIG. 25 is detailed cross sectional view of an end assembly for coupling the first assembly of FIG. 23 to the second assembly of FIG. 24 with the connection pipe approaching the end assembly.

The inner pipe assembly 80 also includes a second pipe 510 extending from the auto tripping ball seat 60. As illustrated in FIG. 4, the second pipe 510 is secured to the auto tripping ball seat 60 by top and bottom connectors 512 and 514 respectively. In operation the top and bottom connectors may have one or more pipe sections therein so as to space the second pipe away from the auto tripping ball seat 60 by a distance required to bridge the compromised well casing section. The second pipe 510 includes a plurality of grooves 516 around an exterior surface thereof stepped so as to permit movement of the end collar 504 in a direction towards the first end 12 of the assembly 10 only. As illustrated in FIG. 25, the end collar 504 includes a corresponding indexed ring 520 therein adapted to engage upon the grooves 516 so as to permit such movement only. As illustrated in FIG. 25, the tag ring 506 includes an entrance end having a profile defined by a series of rectangular blocks or castellations 530 therearound. The distal end of the second pipe 532 includes a corresponding end surface so as to be engageable therein.

Figure 23:
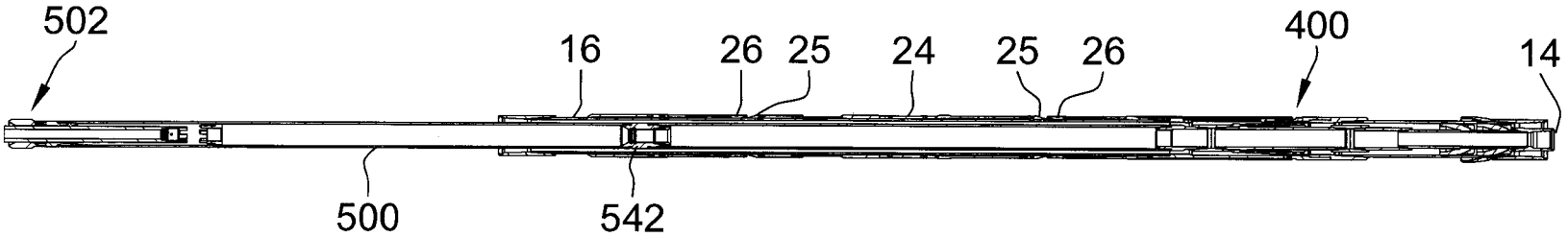
FIG. 23 is side view of a first assembly for use in forming the casing patch assembly of FIG. 1.
Figure 24:
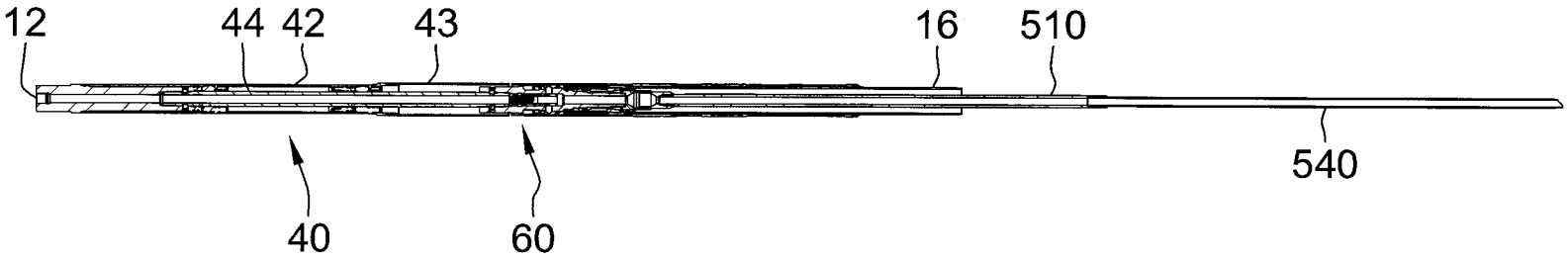
FIG. 24 is side view of a second assembly for use in forming the casing patch assembly of FIG. 1.

In operation, as illustrated in FIG. 23, the bottom assembly comprising the bottom seal, bottom seal activation assembly 400 and first pipe 500 along with the end assembly 502 is located within a well bore. Thereafter, a plurality of pipes are secured thereto to form the bridging pipe 16 of a desired length. The second pipe 510 along with the stinger tube 540 may be introduced into the bore and inserted until the distal end 532 of the second pipe 510 engages upon the tag ring 506 to confirm matching lengths of the inner pipe assembly 80 and bridging pipe 16. It will be appreciated that a number of pipes may be located between the top and bottom connectors 512 and 514 to provide the desired length. Thereafter, the top assembly may be completed as illustrated in FIG. 24, comprising the setting tool 40, auto tripping ball seat 60 and second pipe 510 along with the stinger tube 540 and reinserted into the well until the distal end 532 of the second pipe 510 encounters the tag ring 506. Thereafter the top assembly may be rotated to engage the castellations in the second pipe with the corresponding castellations in the tag ring and thereafter rotating the tag ring 506 such that the pins 508 out of the j-shaped slots 509 so as to permit the second pipe 510 to pass therethrough. The top assembly may then be further inserted thereinto to complete the bridging pipe 16 at which point the completed assembly 10 may be inserted in to the well bore to the desired location. As illustrated in FIG. 17, the slidable member 60 and collet arms 66 may be positioned to cover a release hole 440. When the slidable member 60 is shifted downwards as set out above, the release hole 440 may be positioned to be uncovered so as to fluidically connect the interior of the assembly with the annulus thereby preventing pressure build up from removing the assembly from the well bore.

As utilized herein "pipe" shall be defined to include at least one pipe section which may be connected to additional pipe sections of commonly provided lengths which may be joined in any conventional means such as, by way of non-limiting example, welding, couplers or pipe joints as are commonly known. As utilized herein castellation shall be used to describe an end surface of a pipe or other body having a series of rectangular notched indented portions.

While specific embodiments of the invention have been described and illustrated, such embodiments should be considered illustrative of the invention only and not as limiting the invention as construed in accordance with the accompanying claims.

What is claimed is:

1. An apparatus for bridging a section of ruptured casing within an oil well comprising:

a length of bridging pipe extending between first and second ends sized to be located within the casing so as to span the section of ruptured casing;

a first seal located around said bridging pipe proximate to said first end thereof;

a second seal located around said bridging pipe proximate to said second end thereof, wherein said second seal comprises;

top second seal collet arms extending downwardly from a top collet retaining ring disposed around said bridging pipe, said top second seal collet arms extending to distal ends having outwardly oriented pipe engagement surfaces;

top and bottom second seal cones positioned below said top second seal collet arms around said bridging pipe;

a second seal element extending around said bridging pipe between said top and bottom second seal cones;

bottom second seal collet arms extending upwardly from a bottom collet retaining ring disposed around said bridging pipe, said bottom second seal collet arms extending to distal ends having outwardly oriented pipe engagement surfaces; and second seal engagement sleeve surrounding said bridging pipe proximate to said second end thereof;

an installation assembly extending through said bridging pipe operably engaged with said first and second ends of said bridging pipe, wherein said installation assembly is operable to extend each of said first and second seals into engagement with said oil well and wherein said installation assembly is further operable to selectably disengage from said bridging pipe.

2. The apparatus of claim 1 wherein said first seal comprises:

top and bottom first seal collet arms extending away from a first seal retaining ring disposed around said bridging pipe, each of said top and bottom first seal collet arms extending to distal ends having outwardly oriented pipe engagement surfaces;

top and bottom first seal cones positioned adjacent to said distal ends of said top and bottom first seal collet arms around said bridging pipe;

first seal engagement sleeve surrounding said bridging pipe proximate to said first end thereof; and a first seal element extending around said bridging pipe between said top first seal cone and said first seal engagement sleeve.

3. The apparatus of claim 2 wherein said first seal retaining ring, said top first seal cones and said first seal engagement sleeve are temporarily secured to said bridging pipe with shear pins.

4. The apparatus of claim 3 wherein said shear pins securing said first seal retaining ring, said top first seal cones and said first seal engagement sleeve are sheared in order from top to bottom as said bridging pipe moves therethrough.

5. The apparatus of claim 3 wherein said first seal retaining ring, said top first seal cones and said first seal engagement sleeve are removed from engagement with the oil well by retrieval rings adapted to engage thereupon.

6. The apparatus of claim 5 wherein said first seal retaining ring, said top first seal cones and said first seal engagement sleeve are engaged upon in order from top to bottom by said retrieval rings.

7. The apparatus of claim 1 wherein said top collet retaining ring, said top and bottom second seal cones, said bottom retaining ring and said second seal engagement sleeve are temporarily secured to said bridging pipe with shear pins.

8. The apparatus of claim 7 wherein said shear pins securing said top collet retaining ring, said top and bottom second seal cones, said bottom retaining ring and said second seal engagement sleeve are sheared in order from bottom to top as said bridging pipe moves therethrough.

9. The apparatus of claim 7 wherein said shear pin securing said top collet retaining ring is sized larger than said shear pins securing said top and bottom second seal cones, said bottom retaining ring and said second seal engagement sleeve are temporarily secured to said bridging pipe with shear pins.

10. The apparatus of claim 1 wherein said top collet retaining ring, said top and bottom second seal cones, said bottom retaining ring and said second seal engagement sleeve are removed from engagement with the oil well by retrieval rings adapted to engage thereupon.

11. The apparatus of claim 1 wherein said top collet retaining ring, said top and bottom second seal cones, said bottom retaining ring and said second seal engagement sleeve are engaged upon in order from top to bottom by said retrieval rings.

12. The apparatus of claim 1 further comprising a selectably compressible sleeve between said top second seal cone and said second seal element.

13. The apparatus of claim 12 wherein said selectably compressible sleeve comprises a plurality of release arms extending from a sleeve adjacent to said second seal element, said plurality of release arms having end surfaces selectably engageable with a corresponding receptacle sleeve extending from said top second seal cone, wherein said end surfaces of said release arms are maintained in engagement with said receptacle sleeve by said bridging pipe, wherein said recess is located at a position along said bridging pipe corresponding to a position at which said release arms are desired to be released from engagement with said receptacle sleeve.

14. The apparatus of claim 1 wherein said bridging pipe includes a plurality of longitudinal slots extending therealong and further including a carriage within each slot in engagement with said second seal engagement sleeve so as to transmit longitudinal movement of a tool inside said bridging pipe to said second seal engagement sleeve.

15. A method for bridging a section of pipe casing having a compromised section comprising:

providing a length of bridging pipe extending between first and second ends located within the casing so as to span the compromised section of ruptured casing;

locating an installation assembly within said bridging pipe;

positioning said bridging pipe within said pipe so as to span said compromised section of ruptured casing;

with said installation assembly, longitudinally compressing said first end of said bridging pipe so as to extend a first seal therearound located proximate to said first end of said bridging pipe;

releasing said installation assembly from said first end of said bridging pipe;

with said installation assembly, longitudinally compressing said second end of said bridging pipe so as to extend a second seal therearound located proximate to said second end of said bridging pipe;

wherein said second seal comprises;

top second seal collet arms extending downwardly from a top collet retaining ring disposed around said bridging pipe, said top second seal collet arms extending to distal ends having outwardly oriented pipe engagement surfaces;

top and bottom second seal cones positioned below said top second seal collet arms around said bridging pipe;

a second seal element extending around said bridging pipe between said top and bottom second seal cones;

bottom second seal collet arms extending upwardly from a bottom collet retaining ring disposed around said bridging pipe, said bottom second seal collet arms extending to distal ends having outwardly oriented pipe engagement surfaces; and second seal engagement sleeve surrounding said bridging pipe proximate to said second end thereof;

releasing said installation assembly from said second end of said bridging pipe;

removing said installation assembly from said bridging pipe.

* * * * *